US012768187B2

(12) United States Patent
Wynne-Edwards et al.

(10) Patent No.: US 12,768,187 B2
(45) Date of Patent: Oct. 20, 2026

(54) WAVE POOL

(71) Applicant: WHITEWATER WEST INDUSTRIES LTD., Richmond (CA)

(72) Inventors: Alexander Wynne-Edwards, Victoria (CA); Andrew Tymiak, Surrey (CA); Clement Ginestet, Saint Ouen (FR)

(73) Assignee: WHITEWATER WEST INDUSTRIES LTD., Richmond, CA (US)

( * ) Notice: Subject to any disclaimer, the term of this patent is extended or adjusted under 35 U.S.C. 154(b) by 0 days.

(21) Appl. No.: 19/358,087

(22) Filed: Oct. 14, 2025

(65) Prior Publication Data

US 2026/0092462 A1 Apr. 2, 2026

Related U.S. Application Data

(63) Continuation of application No. 17/932,250, filed as application No. PCT/CA2021/000010 on Feb. 15, 2021.

(60) Provisional application No. 63/026,508, filed on May 18, 2020, provisional application No. 62/976,961, filed on Feb. 14, 2020.

(51) Int. Cl.
*E04H 4/00* (2006.01)

(52) U.S. Cl.
CPC ..... *E04H 4/0006* (2013.01)

(58) Field of Classification Search
CPC ..... E04H 4/0006; E04H 4/00; A47K 3/00; A47K 3/10; E03D 5/00
USPC ..... 4/491, 488, 405, 541.1, 904, 506
See application file for complete search history.

(56) References Cited

U.S. PATENT DOCUMENTS

| | | | |
|---|---|---|---|
| 4,522,535 | A | 6/1985 | Bastenhof |
| 4,792,260 | A | 12/1988 | Sauerbier |
| 4,905,987 | A | 3/1990 | Frenzi |
| 4,954,014 | A | 9/1990 | Sauerbier et al. |

(Continued)

FOREIGN PATENT DOCUMENTS

| | | | |
|---|---|---|---|
| AU | 2021218696 | A1 | 10/2022 |
| CA | 3085920 | A1 | 6/2019 |

(Continued)

OTHER PUBLICATIONS

Applicant-Initiated Interview Summary for U.S. Appl. No. 18/057,150, dated Mar. 11, 2025, 3 pages.
Corrected Notice of Allowance for U.S. Appl. No. 17/932,250, dated Oct. 23, 2025, 2 pages.
Corrected Notice of Allowance for U.S. Appl. No. 17/932,250, dated Oct. 31, 2025, 4 pages.
Corrected Notice of Allowance for U.S. Appl. No. 18/654,442, dated Jul. 25, 2025, 8 pages.

(Continued)

*Primary Examiner* — Lori L Baker
(74) *Attorney, Agent, or Firm* — Sterne, Kessler, Goldstein & Fox, P.L.L.C.

(57) ABSTRACT

A pool wave generator can include one or more chambers; and a pool area, the one or more chambers positioned on a first side of the pool area, the pool area further comprising: a first lateral side extending outwards from a first terminal end of the first side; a second lateral side extending outwards from a second terminal end of the first side, the second terminal end defined opposite on the first side from the first terminal end; a pool interior positioned at least partially between the first lateral side and the second lateral side; and a shore side positioned opposite from the first side, the shore side defining a first lobe and a second lobe, the shore side further defining an interior indentation between the first lobe and the second lobe.

30 Claims, 9 Drawing Sheets

(56) References Cited

U.S. PATENT DOCUMENTS

| | | | | |
|---|---|---|---|---|
| 4,999,860 | A | 3/1991 | Chutter et al. | |
| 5,171,101 | A | 12/1992 | Sauerbier et al. | |
| 5,186,578 | A | 2/1993 | Perslow | |
| 6,241,422 | B1 | 6/2001 | Makowski | |
| 6,460,201 | B1 | 10/2002 | Lochtefeld | |
| 6,912,738 | B2 | 7/2005 | Black | |
| 7,537,414 | B1 | 5/2009 | Raike | |
| 8,303,213 | B2 | 11/2012 | McFarland | |
| 8,434,966 | B1 | 5/2013 | McFarland | |
| 8,496,403 | B2 | 7/2013 | Lochtefeld et al. | |
| 8,561,221 | B2 | 10/2013 | Lochtefeld et al. | |
| 9,068,371 | B2 | 6/2015 | McFarland | |
| 9,103,133 | B2 | 8/2015 | McFarland | |
| 9,279,263 | B2 | 3/2016 | McFarland | |
| 10,145,135 | B2 | 12/2018 | McFarland et al. | |
| 10,280,640 | B2 | 5/2019 | McFarland et al. | |
| 10,364,584 | B2 | 7/2019 | Odriozola Sagastume | |
| 10,449,433 | B1 * | 10/2019 | Bennett | A63B 69/125 |
| 10,526,806 | B2 | 1/2020 | McFarland | |
| 10,851,554 | B1 * | 12/2020 | McFarland | E04H 4/0006 |
| RE49,215 | E | 9/2022 | McFarland | |
| 11,572,702 | B2 * | 2/2023 | Lochtefeld | E04H 4/0006 |
| 11,891,834 | B2 | 2/2024 | Ginestet et al. | |
| 12,029,990 | B2 * | 7/2024 | McFarland | G06F 3/0486 |
| 12,352,068 | B2 * | 7/2025 | Fincham | A63B 69/0093 |
| 12,404,688 | B2 * | 9/2025 | Ginestet | E04H 4/0006 |
| 2002/0056157 | A1 | 5/2002 | Lochtefeld | |
| 2003/0009821 | A1 | 1/2003 | Lochtefeld | |
| 2003/0106146 | A1 | 6/2003 | Black | |
| 2006/0253969 | A1 * | 11/2006 | Johnson | E04H 4/0006 4/491 |
| 2009/0151064 | A1 | 6/2009 | Mladick et al. | |
| 2010/0011497 | A1 | 1/2010 | Johnson | |
| 2012/0021665 | A1 | 1/2012 | Hunter | |
| 2014/0105685 | A1 | 4/2014 | McFarland | |
| 2014/0133914 | A1 | 5/2014 | Lochtefeld et al. | |
| 2015/0089731 | A1 | 4/2015 | Lochtefeld | |
| 2018/0087284 | A1 | 3/2018 | McFarland | |
| 2018/0135324 | A1 | 5/2018 | Zars | |
| 2018/0147469 | A1 | 5/2018 | Bennett et al. | |
| 2018/0209159 | A1 | 7/2018 | Perslow | |
| 2021/0148129 | A1 | 5/2021 | Fricano | |
| 2023/0243171 | A1 | 8/2023 | Lochtefeld | |
| 2024/0011312 | A1 | 1/2024 | Wynne-Edwards et al. | |
| 2024/0209645 | A1 | 6/2024 | Wynne-Edwards et al. | |
| 2024/0279947 | A1 | 8/2024 | Ginestet | |
| 2025/0043582 | A1 | 2/2025 | Slater et al. | |
| 2025/0361736 | A1 | 11/2025 | Ginestet | |

FOREIGN PATENT DOCUMENTS

| | | | |
|---|---|---|---|
| DE | 1816519 | A1 | 6/1970 |
| JP | S52121935 | A | 10/1977 |
| WO | 0064549 | A2 | 11/2000 |
| WO | 2008042966 | A2 | 4/2008 |
| WO | 2012150908 | A1 | 11/2012 |
| WO | 2018188740 | A1 | 10/2018 |
| WO | 2021159200 | A1 | 8/2021 |
| WO | 2021232138 | A1 | 11/2021 |
| WO | 2025227237 | A1 | 11/2025 |

OTHER PUBLICATIONS

Corrected Notice of Allowance for U.S. Appl. No. 18/654,442, dated May 19, 2025, 2 pages.
Final Office Action for U.S. Appl. No. 18/057,150, dated Dec. 19, 2024, 10 pages.
Final Office Action for U.S. Appl. No. 18/057,150, dated Jun. 17, 2025, 17 pages.
Final Office Action for U.S. Appl. No. 18/654,442, dated Dec. 12, 2024, 14 Pages.
First Office Action for Chinese Application No. 20218049647, dated Feb. 28, 2025, 10 pages.
International Search Report and Written Opinion for International Application No. PCT/CA2021/000010, dated Jun. 9, 2021, 11 pages.
International Search Report and Written Opinion for International Application No. PCT/CA2021/000045, dated Aug. 25, 2021, 8 pages.
International Search Report and Written Opinion for International Application No. PCT/CA2025/050615, mailed Aug. 13, 2025, 7 Pages.
Non-Final Office Action for U.S. Appl. No. 17/932,250, dated Jun. 30, 2025, 18 pages.
Non-Final Office Action for U.S. Appl. No. 18/057,150, dated Aug. 15, 2024, 14 Pages.
Non-Final Office Action for U.S. Appl. No. 18/057,150, dated May 9, 2025, 12 pages.
Non-Final Office Action for U.S. Appl. No. 18/654,442, dated Aug. 16, 2024, 13 pages.
Notice of Allowance for U.S. Appl. No. 17/932,250, dated Oct. 17, 2025, 8 pages.
Notice of Allowance for U.S. Appl. No. 18/654,442, dated May 8, 2025, 9 pages.
Office Action for Australian Application No. 2021218696, dated Dec. 23, 2025, 6 Pages.
Office Action for Australian Application No. 2021274311, dated Jun. 25, 2024, 2 pages.
Office Action for Brazilian Application No. BR112022019731, dated Nov. 4, 2025, 6 pages.
Office Action for Canadian Application No. 3172128, dated Dec. 15, 2023, 4 pages.
Office Action for Canadian Application No. 3172128, dated Sep. 16, 2024, 3 pages.
Office Action for Canadian Application No. CA3179309, dated Nov. 19, 2025, 4 pages.
Office Action for Mexican Application No. MX/a/2022/014589, dated Sep. 17, 2025, 9 pages.
Supplementary European Search Report for European Application No. 21754167.1, dated Feb. 5, 2024, 8 Pages.
Supplementary European Search Report for European Application No. 21807609.9, dated Jun. 19, 2024, 6 Pages.
Non-Final Office Action for U.S. Appl. No. 18/057,150, dated Dec. 10, 2025, 31 pages.
Notice of Allowance for U.S. Appl. No. 17/932,250, dated Feb. 5, 2026, 7 pages.
Office Action for Mexican Application No. MX/a/2022/014589, dated Jan. 13, 2026, 13 pages.

* cited by examiner

WAVE POOL

REFERENCE TO RELATED APPLICATIONS

This application is a continuation of U.S. application Ser. No. 17/932,250, filed Aug. 8, 2023, which is a national stage entry of PCT Application No., PCT/CA2021/000010, filed on Feb. 15, 2021, which claims the benefit of U.S. Provisional Application Nos. 63/026,508, filed May 18, 2020, and 62/976,961, filed Feb. 14, 2020, each of which are hereby specifically incorporated by reference herein in their entireties.

BACKGROUND

Water attractions have brought fun to different people from different geographic locations for many generations. The water attraction permits different geographic areas to have access to simulated experiences from other geographic areas. For example, a wave pool may approximate an experience at a beach.

Different water attractions may be used to approximate natural environments to permit users to experience sports and activities from these other environments. For example, sheet wave rides simulate a surfing or boogie boarding experience that permits a rider, with their body or a thin board, to ride upon a sheet flow of water that is contoured by an underlying ride surface. The sheet wave ride does not provide a true surfing experience, as the sheet flow does not permit wave breaking or the use of an actual surfboard.

Deep wave surfing systems are provided that attempt to create a more accurate approximation of the surfing experience in the natural environment. U.S. Pat. Nos. 8,434,966, 9,103,133, 9,279,263, 10,145,135, 10,280,640, and 10,526,806 disclose deep wave surfing simulators, each of which is incorporated by reference in their entirety herein.

SUMMARY

A pool wave generator is disclosed having a pool area and a plurality of chambers for generating a wave in the pool area. The plurality of chambers may be used to retain or release water into the pool to create a desired wave.

The plurality of chambers may be separated from an edge of the pool to create a gap there between. A passage may be positioned below the gap to fluidly couple the chamber to the pool. The passage may be used to reduce turbidity or limit eddy currents in the fluid as the water is moved between the chamber and the pool. The gap may permit spectators or the storage of controllers, blowers, pumps, or other components and/or equipment of the pool wave generator. In an exemplary embodiment, the gap may include a floor for supporting a spectator. The gap may also include an edge that corresponds to an extension of an edge of the pool. The edge of the gap may include a transparent wall to permit observation of the pool activities from a location within the gap.

The pool wave generator may also include a pool floor and/or pool edge for influencing a wave profile or wave characteristics and/or for creating different wave zones. The pool floor may include different combinations of tapered sections and/or horizontal sections, or other contours for creating different breaking waves of different characteristics.

The pool wave generator may also include outwardly flared walls extending away from the plurality of chambers. The wall positions may be used to reduce and/or control eddy currents created from the water's interaction with the wall and/or floor.

Also disclosed is a pool wave generator comprising one or more chambers; and a pool area, the one or more chambers positioned on a first side of the pool area, the pool area further comprising: a first lateral side extending outwards from a first terminal end of the first side; a second lateral side extending outwards from a second terminal end of the first side, the second terminal end defined opposite on the first side from the first terminal end; a pool interior positioned at least partially between the first lateral side and the second lateral side; and a shore side positioned opposite from the first side, the shore side defining a first lobe and a second lobe, the shore side further defining an interior indentation between the first lobe and the second lobe.

Also disclosed is a pool wave generator comprising one or more chambers; and a pool area, the one or more chambers positioned on a first side of the pool area, the pool area defining a shore side positioned opposite from the first side defining a concave curve relative to an interior of the pool area.

Also disclosed is a pool wave generator comprising one or more chambers; and a pool area, the one or more chambers positioned on a first side of the pool area, the first side defined by a first linear wall, the one or more chambers linearly aligned parallel to the first linear wall, the pool area further comprising: a first lateral side extending outwards from a first terminal end of the first side, the first lateral side at least partially defined by a second linear wall, an interior angle between the first side and the first lateral side being between 130 degrees and 170 degrees; a second lateral side extending outwards from a second terminal end of the first side, the second terminal end defined opposite on the first side from the first terminal end, the second lateral side at least partially defined by a third linear wall, the second linear wall and the third linear wall tapering inward toward the first linear wall; a pool interior positioned at least partially between the first lateral side and the second lateral side; and a shore side positioned opposite from the first side, the shore side defining a first lobe and a second lobe, the shore side further defining an interior indentation between the first lobe and the second lobe, the first lobe defined at least partially by a first concave curve relative to the pool interior, the second lobe defined at least partially by a second concave curve relative to the pool interior, the interior indention defined at least partially by a convex curve relative to the pool interior, the first concave curve intersecting the second linear wall of the first lateral side.

DRAWINGS

DESCRIPTION

The following detailed description illustrates by way of example, not by way of limitation, the principles of the invention. This description will clearly enable one skilled in the art to make and use the invention, and describes several embodiments, adaptations, variations, alternatives and uses of the invention, including what is presently believed to be the best mode of carrying out the invention. It should be understood that the drawings are diagrammatic and schematic representations of exemplary embodiments of the invention, and are not limiting of the present invention nor are they necessarily drawn to scale.

Exemplary embodiments described herein include a pool configured to create waves. The pool may include one or more chambers at one end that are configured to receive and release water into the pool for generating the waves. Exemplary chambers are provided to reduce turbulence and generate better waves for riding. The pool may be configured to generate zones that define or generate waves of different profiles and/or for riding by riders of different experience levels.

Figure 1A:
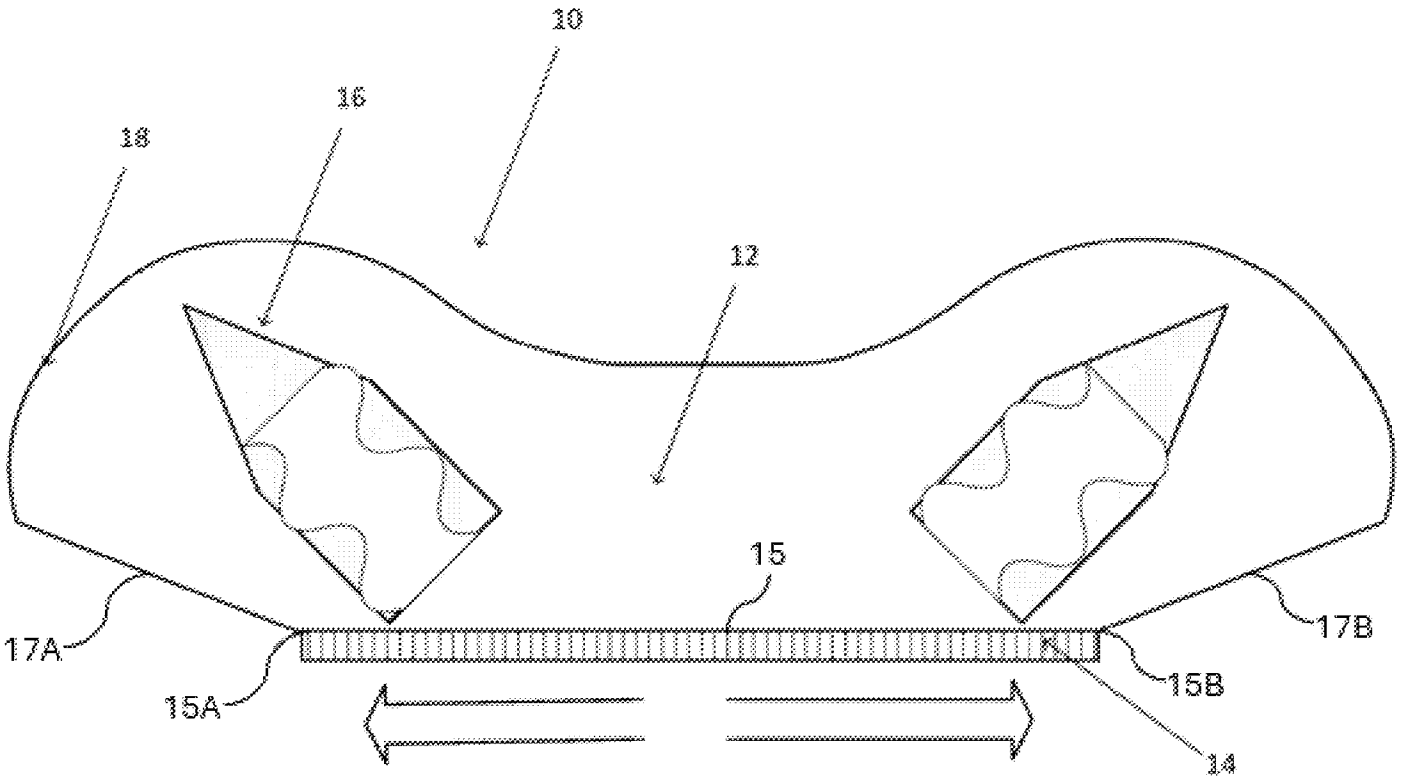
FIGS. 1A-1B illustrate exemplary pool wave generators according to embodiments of the invention.

Although embodiments of the invention may be described and illustrated herein in terms of a pool wave generator having unique and novel features, it should be understood that embodiments of this invention do not require or necessitate the inclusion of each of the features. The instant disclosure does not require any specific component, configuration, or feature, and any combination of features may be incorporated or combined and remain within the full description of the invention. For example, the inclusion of the elongated chamber between the chamber and the pool to reduce eddy currents may be used in any conventional features of a pool wave generator. Similarly, the inclusion of the spectator area, and/or the bottom contour to generate different wave zones may similarly be used alone or in conjunction with other features described herein. FIG. 1A illustrates and exemplary wave pool according to embodiments of the invention. The exemplary pool wave generator 10 may include a pool area 12 and one or more chambers 14 for generating a wave within the pool area. The wave 16 may propagate away from the chamber(s) 14 and toward a shore side 18 of the pool.

In an exemplary embodiment, the pool area 12 may be a recessed pool configured to hold water. The shore side 18 may be a wall for retaining the water. The wall may be vertical or may be sloped. In an exemplary embodiment, the shore side is created by a sloped bottom of the pool to approximate or similar a beach area. As the water is pushed across the pool area 12 by the release of water from the chambers 14, the water may travel toward the shore side and travel across and up the sloped bottom until the water stops and eventually comes back to the pool area along the sloped bottom under the influence of gravity.

Figure 1B:
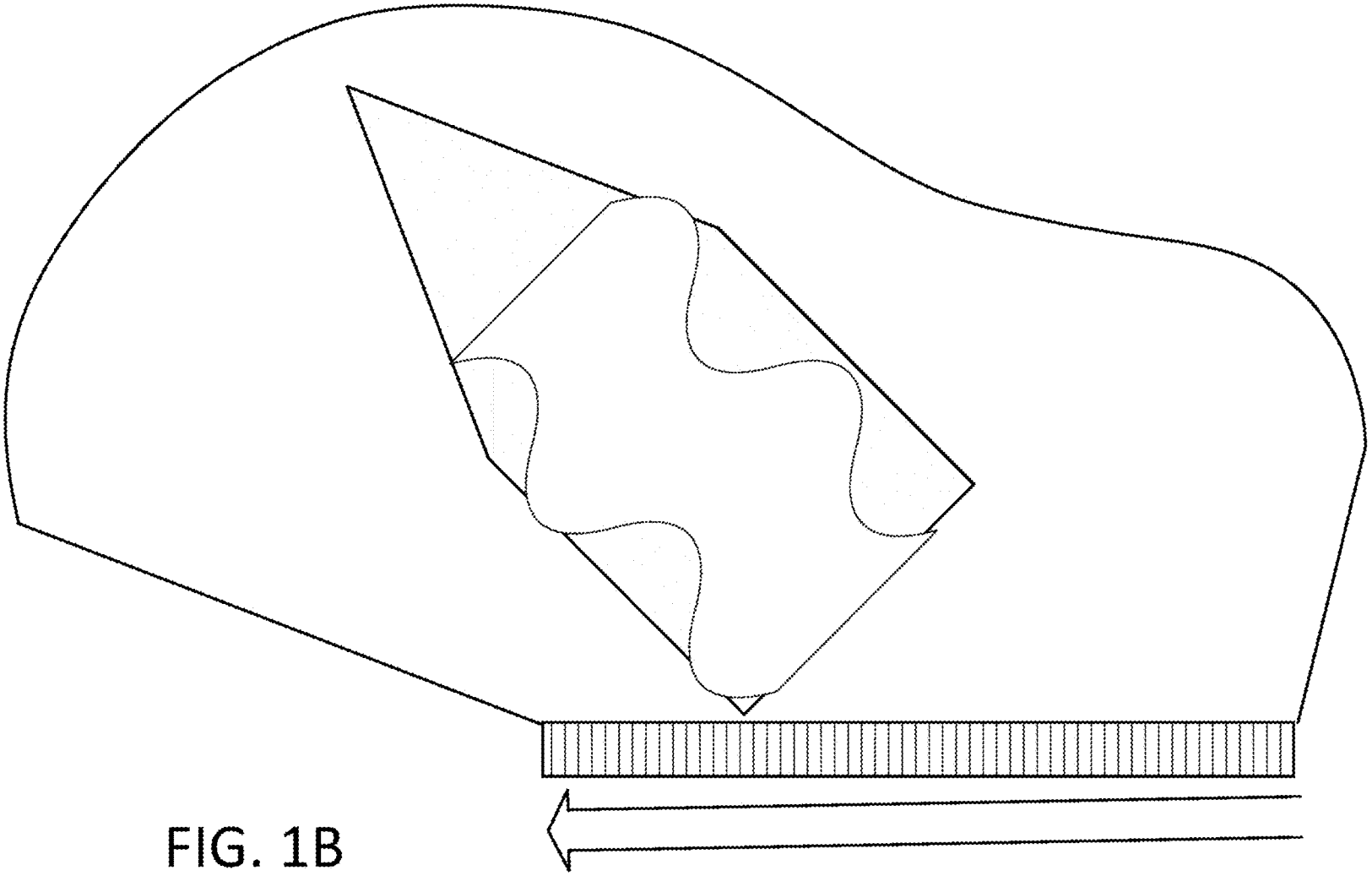

FIG. 1A illustrates an exemplary pool wave generator that comprises two sides in which a wave may be propagated from the chambers toward opposite ends of the pool. This may be used to create different areas that may have similar or different wave profiles for use by different riders. The different areas may be used to create waves for rider having levels of experience. Exemplary embodiments include a pool wave generator in which a wave is propagated in a single direction, such as illustrated in FIG. 1B.

As represented by the arrows adjacent the chambers 14, the chambers 14 may release water into the pool area 14 sequentially. The chambers may be linearly aligned along one side of the pool 12. The chambers may also include different directions, configurations, and orientations. The release of water from the chambers may be used to control wave attributes, such as a wave height, direction, shape, etc. As illustrated in FIG. 1A, chambers toward the middle of the plurality of chambers are released together and then the chambers may release sequentially moving outward toward opposing ends of the plurality of chambers. The chambers may also be configured to release in different directions or sequence, such as from one end to the other (as illustrated in FIG. 1B) or from opposing ends toward the middle of the plurality of chambers.

FIG. 1A illustrates an exemplary embodiment in which a linear arrangement of chambers is provided along one edge of the pool area 12. The chambers may traverse an entire length of the edge of the pool. As illustrated, projecting immediately from the end of the last chamber on the edge of the pool, a lateral side 17A, 17B of the pool wall 19 may extend at a non-zero angle measured from the linear extension of the edge of the pool defined by the chambers. In other words, the lateral wall may immediately extend forward from the end of the chamber. The lateral wall may also have a component that extends outward in a continued extension of the chamber linear direction, thus forming a non-zero, non-perpendicular angle with the linear extension of the pool edge comprising the chambers. Angling the pool wall on a lateral side 17A, 17B of the pool may reduce the amount of water required to fill a pool, and reduce the areas of the pool that may produce less desirable wave action.

Figure 1C:
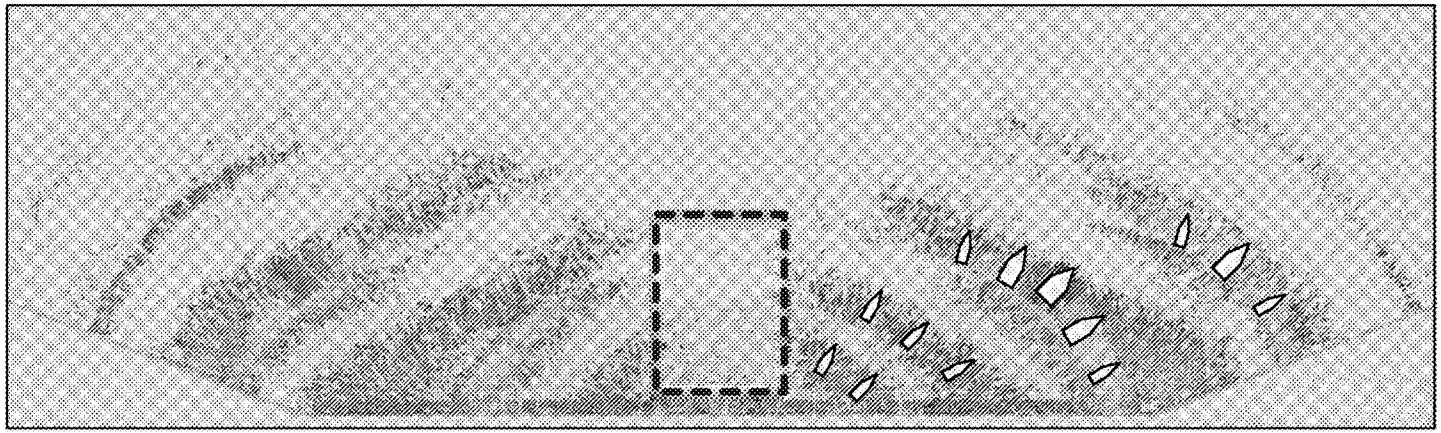
FIGS. 1C-1E illustrate exemplary water velocity diagrams corresponding to exemplary pool configurations described herein.

FIG. 1C illustrates an exemplary vector modelling of speed of the water and corresponding waves during wave generation of an exemplary wave pool generator according to embodiments described herein. As illustrated, defined wave areas can be seen as the wave traverses the length of the pool. As illustrated by the dotted box in the middle of the pool area, the pool may include a dead spot that can be used as a paddling channel and/or waiting zone to enter the wave areas.

Figure 1E:
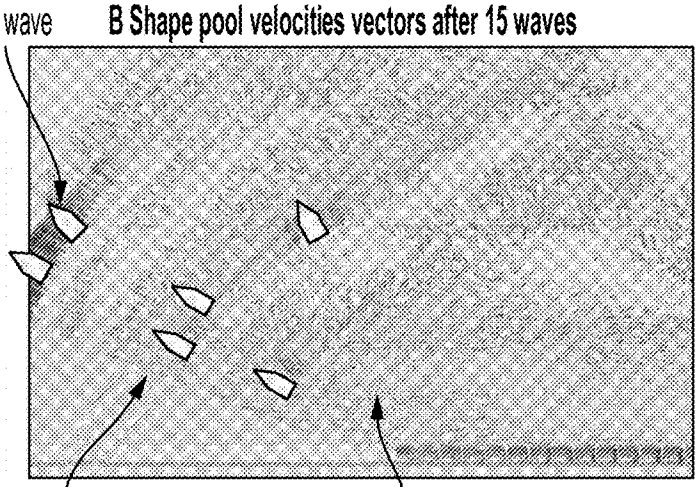
Figure 1D:
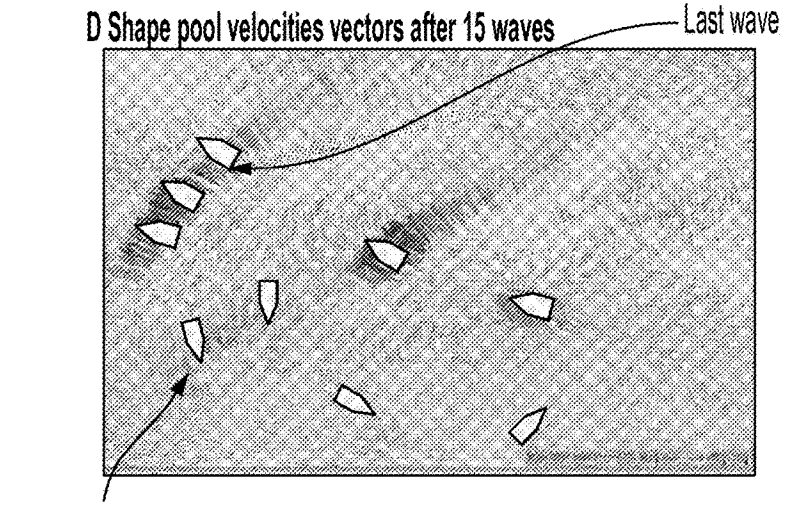

Angling the opposing lateral sides 17A, 17B may also be used to control the currents of the pool according to embodiments described herein. FIG. 1D illustrates an exemplary wave water velocity map with a pool that is configured with an extension wall at opposing ends of the pool so that the side of the pool with the chambers includes a linear continuation of the wall beyond the chambers. As illustrated, the pool experiences significant return currents towards the flat wall. This creates a vortex at the end of the chambers that can interfere with wave propagation. FIG. 1E illustrates an exemplary wave water velocity map with a pool having angled walls according to embodiments described herein. Unexpectedly, the removal of the water flow path back to the chambers lessens the resulting vortex at the end of the chambers. It is believed that the angled wall focuses the remaining wave energy, which can then be used for creating an intermediate wave riding area according to embodiments described herein. The wave water velocity map illustrates the velocity of water during the wave generation, with the arrow representing the direction and quantity (a larger area arrow represents a greater velocity or faster wave).

Exemplary embodiments described herein may include a pool having a first linear side 15 in which a plurality of chambers are configured to fluidly couple and dispense water into the pool along the first linear side 15. One or more chambers may be configured along an entirety of the first linear edge. The pool may include two opposing lateral sides 17A, 17B extending from terminal ends 15A, 15B of the first linear side 15. The opposing lateral sides may extend forward of the first linear side at an angle. The angle of each lateral side may be the same or different, depending on the pool configuration. The opposing lateral sides may extend outward and forward from the first linear side at an oblique angle. Exemplary embodiments of the angled opposing lateral sides may assist in current mitigation. Exemplary embodiments of the angled opposing lateral sides may also focus a wave's energy such that a wave may be reformed for different experience levels. Exemplary embodiments include an oblique angle measured from the front of the linear position of chambers outward and around through the pool area and to the linear side wall. The oblique angle is preferable greater than 90 degrees and less than 180 degrees. The oblique angle may also be greater than 110 degrees, greater than 120 degrees greater than or approximately 135 degrees, greater than or approximately 150 degrees, or greater than or approximately 160 degrees. The oblique angle may also or in addition be less than 180 degrees, less than 170 degrees, less than or equal to 160 degrees, less than or equal to 150 degrees, or less than or equal to 135 degrees.

Figure 2A:
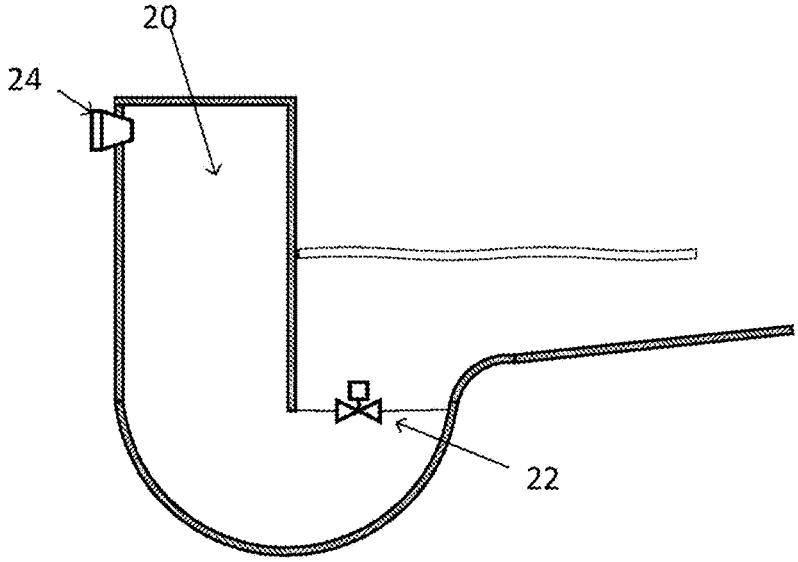
FIGS. 2A-2C illustrate an exemplary wave generating chamber and associated control thereof to generate a wave in the dep wave pool described herein.
Figure 2B:
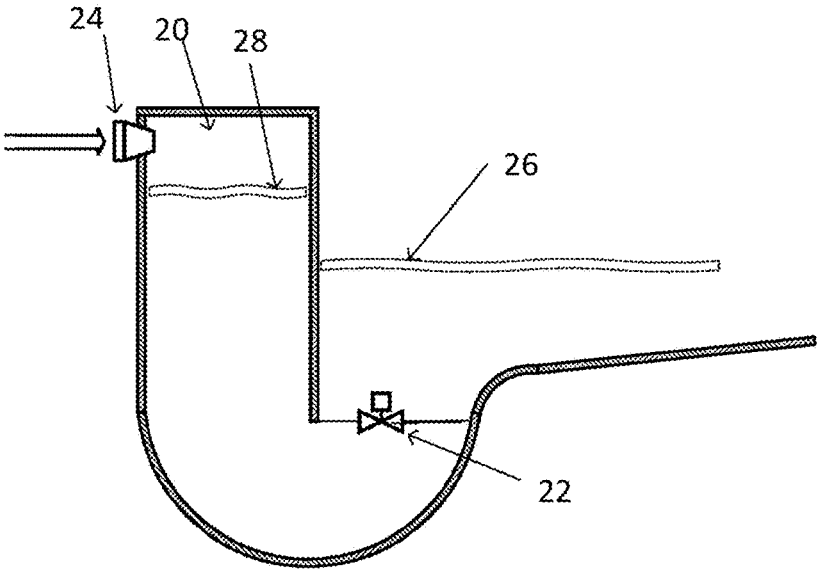
Figure 2C:
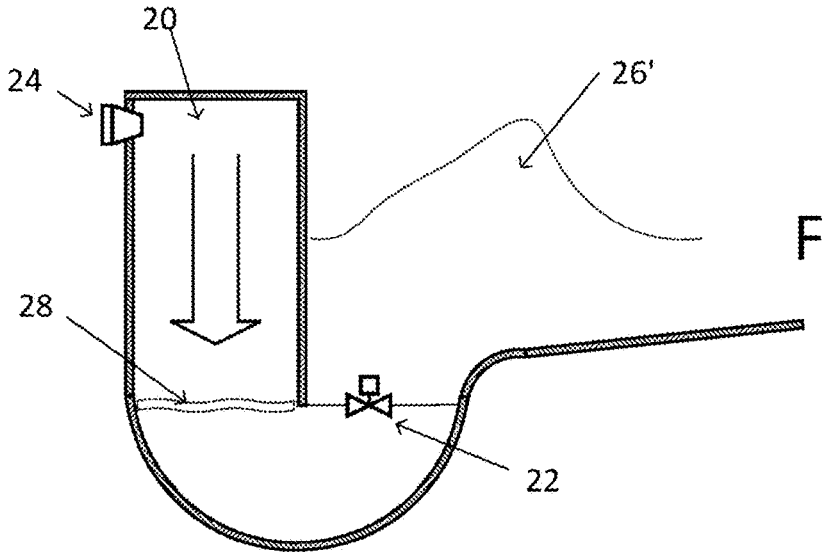

FIGS. 2A-2C illustrate an exemplary wave generating chamber and associated control thereof to generate a wave in the wave pool described herein. The chamber 20 may be configured to retain water at a chamber water level 28 that when released into the pool, a pool water level 26 is increased creating a wave 26' that propagates away from the chamber 20, across the pool. The chamber may include one or more valves 22, 24 for controlling the retention and release of the water within the chamber. In an exemplary embodiment, a first valve 22 may control the water flow into and out of the chamber 20. In an exemplary embodiment, a second valve 24 may control air or fluid flow into and out of the chamber 20. The second valve 24 may be used to introduce pressurized gas into the chamber and/or to vent gas from the chamber to assist in the movement of the water into and out of the chamber. The second valve 24 may comprise one or more valves in order to control the inflow and outflow of gas from the chamber 20.

As seen in FIG. 2A, the system may have been released so that no water is in the chamber 20 or the water level 28 in the chamber is at a low level (such as illustrated in FIG. 2C). The second valve 24 may be opened to purge air from the chamber. The chamber may be configured to evacuate air from the chamber 20, such that the chamber is negatively pressurized. The vent 24 may also be open, such that the chamber 20 is at neutral pressure and the air in the chamber is permitted to vent as the chamber is filled with water. The first valve 22 is opened and the rush of water into the chamber elevates the water level in the chamber.

As seen in FIG. 2B, the first valve 22 is closed to retain the chamber water level 28 at a height greater than the pool water level 26. The chamber may then be filled with a pressurized gas to impose additional pressure on the water within the chamber. The second valve 24 is then closed and the first valve is then opened.

As seen in FIG. 2C, the pressurized air in the chamber pushes the water level 28 within the chamber, which in turn surges water out of the chamber to generate a wave 26' that propagates across the pool. The first valve 22 may be closed while the air in the chamber is vented, such as through the second valve 24. The first valve 22 may be closed to limit the amount of water back into the chamber to minimize disruption to the formed wave 26'. The first valve 22 may also remain open to permit the water to return to the chamber and be closed as discussed with respect to FIG. 2B.

In an exemplary embodiment, the system is configured to cycle through the process of releasing water from the chamber and permitting the resurgence of water into the chamber. The system may also include a delay after any number of cycles to permit the water in the pool to settle and reduce turbulence that could affect wave generation.

In the exemplary embodiment provided herein, two valves are illustrated-a first valve 22 for water control and a second valve 24 for gas control. Any combination of valves may be used and are within the scope of the instant disclosure. For example, multiple gas valves may be used to vent the chamber, inject pressurized gas, etc., and multiple fluid valves may be used to emit or retain the water within the chamber. The order and/or cycle of the valves as described herein is exemplary only. Any number of different ways may be used to release the wave using valves, gates, or other methods. The valves may be opened, closed, in different ways. For example, the system may use a purge system to remove gas from the chamber before resurgence of water to elevate the water level returning to the chamber. For example, the system may not use a pressurized gas system for expelling the water into the pool. For example, single direction valves may be used such that valves do not necessitate individual actuation to open and close each valve. The valves of each chamber may be controlled individually or as a sequence within a larger operation of the entire pool system.

Figure 3:
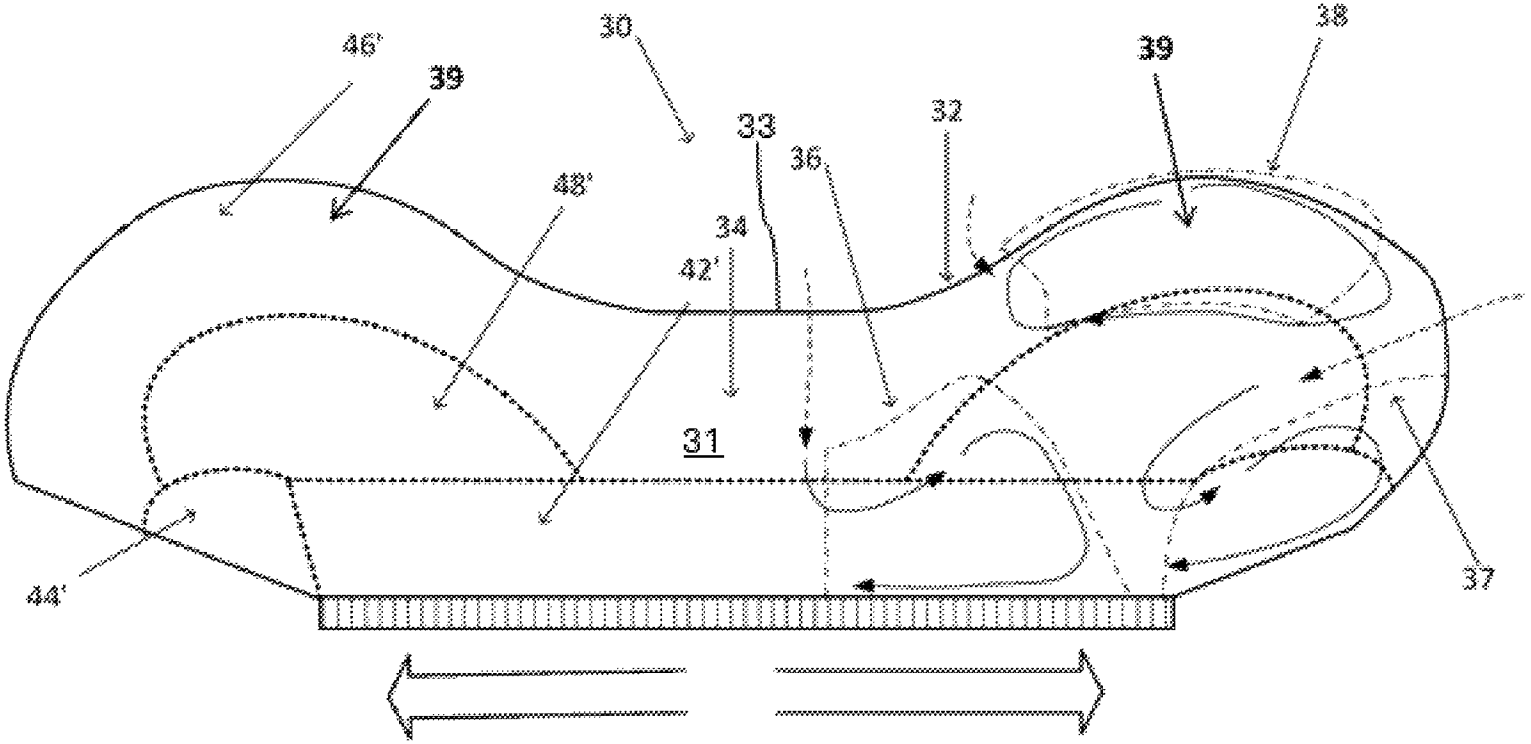
FIG. 3 illustrates as exemplary wave pool for generating different zones having different wave characteristics according to embodiments of the invention.

FIG. 3 illustrates as exemplary wave pool 30 for generating different zones having different wave characteristics according to embodiments of the invention. In an exemplary embodiment, the pool profile 32 and the pool floor 34 may be contoured to define a desired wave profile and/or to create multiple wave zones 36, 37, and 38.

In an exemplary embodiment, multiple wave zones 36, 37, 38 may be created. The creation of multiple wave zones may be generated from a single wave generation cycle of the chambers. For example, the chambers may release in sequence to form a first wave. That first wave may change profile, height, direction, etc. as the wave propagates across the pool floor. The wave may also deteriorate and/or reform based on the underlying topography of the pool floor. As illustrated, for example in FIG. 3, three wave zones are generated for a single wave generation cycle on one side of the pool. The pool may have a mirror configuration, such that the entirety of the pool has six wave zones. However, three of the wave zones are independent from another three of the wave zones since a different wave or portion of the wave creates the first three wave zones than the wave or another portion of the wave that creates the second three wave zones. Any combination of wave zones may be generated and the combination of two sides of three for a total of six zones is illustrative only. In an exemplary embodiment, the wave pool may have only one, two, three, or more wave zones. The pool may have a mirrored configuration such as in FIG. 1A, thereby doubling the wave zones or the pool may be a single side as in FIG. 1B. The opposing sides of the pool may also be configured differently, such that different wave zones may be created across the entirety of the pool.

As illustrated, a first wave zone 36 is adjacent the wave generating chambers. The wave at this portion is at its highest. This area may be for the most experienced riders. It may also be for the short board riders.

As illustrated, a second wave zone 37 may be in an area of the pool after the wave leaves the chambers that runs along a sidewall or edge of the pool. The wave will dissipate energy and reduce height after the wave propagates away from the chambers. This area is therefore created for intermediate riders and longboard riders.

As illustrated, a third wave zone 38 may be adjacent the side of the pool away from the chambers. The edge may correspond to a third (shore) area 46' of the pool. This area may have a shallow depth and may have an inclined floor bottom. The third wave zone 38 may be for beginning wave riders. This area may also be used for boogie boards, foam boards, kayaks, or skimming boards. This area may also be used for body riding or wave jumping.

The bottom of the pool may have areas that correspond or influence the wave zones. For example, a first area 42' of the pool bottom may generally correspond to the first wave zone 36, while a second area 44' of the pool bottom may generally correspond to the second wave zone 37, and the third area 46' of the pool bottom may generally correspond to the third wave zone 38. A fourth area and/or other areas may be used to generate and separate the different wave zones and/or be used to reform waves as the wave propagates from the chambers. The different areas of the pool floor are discussed more fully with respect to FIG. 4.

The different floor bottom areas may be used to influence a wave profile. For example, the depth of the floor may influence a wave size, while the slope of the floor may affect the wave shape. The first area 42' adjacent the chambers may therefore generate a wave zone 36 for the most experienced riders. This area may be approximately 2-6 meters deep. This area may have a floor bottom with a greater slope or incline toward the shore or opposing side of the pool and/or may have the greatest depth. The third area 46' may be adjacent the shore or edge of the pool away from the chambers and may generate a wave zone 38 for the most inexperienced riders. This area may therefore have a floor bottom with the smallest slope or incline toward the edge and/or may have the shallowest depth. The gentler slope may make the wave brake softer.

In an exemplary embodiment, the edge of the pool away from the chambers may also be contoured to influence the wave characteristics. For example, in the area of the third wave zone, or the area for beginners, the edge may be elevated toward a middle of the pool, on an opposite side of the pool from the middle chambers of the sequence of chambers. This elevation may form a shore or dry indentation into the side of the pool. As the wave propagates across the pool from the chambers toward the shore, the wave may wrap around the elevation extending into the pool area. Other or additional elevations may be provided along the short to create additional wave zones. In an exemplary embodiment, an elevation may be used to separate and/or redirect a wave.

Referring to FIG. 3, the shore with two wave generating sides may have a shore configuration with two exterior side lobes 39. The lobes 39 may correspond generally with the third wave zone 38. The lobes 39 may be shaped as a concave (in reference to an interior 31 of the pool) edge portion of the side of the pool opposite the chamber side of the pool. The lobes 39 may be separated with an interior indentation 33 of the pool. The interior indentation 33 may be created by elevating the pool floor so that the width of the water contained in the pool is reduced between the shore and the chambers at the interior indentation 33 and is greater between the chambers and the shore at the lobes 39. The interior indentation 33 may be configured as a convex (in reference to an interior 31 of the pool) edge portion of the side of the pool opposite the chamber side of the pool. Because the floor of the pool may be tapered upward at the shore or the side of the pool opposite the chambers, the "edge" of this side of the pool may be harder to determine. Therefore, in one embodiment, the edge may be considered as the water line of the pool when a water level is at rest without wave propagation. As illustrated in FIG. 3 the edge opposite the chambers that follows the water line would therefore extend outward away from the chambers as the edge is traversed from the lateral side wall of the pool toward the middle of the pool. After reaching a maximum width distance (perpendicular distance across the pool from the side containing the chambers to the location on the shore edge) the shore edge or the edge opposite the chambers then curves back toward the chambers as the edge is traversed from the maximum width toward the middle of the shore edge. The interior of the shore edge may include different contours, such as may be generally linear, may be concave and/or convex. This area may include a wading or little pool area. This area may also include an entrance area for the ingress and egress of riders to the various wave zones.

As illustrated, the chambers may release water into the pool in sequence generating a wave. If the chambers first open at the middle of the sequence of chambers and then open sequentially in opposing directions toward each end, both left and right waves will propagate from the chambers and break at approximately the same time (assuming a mirror configuration of the pool). The chamber sequencing may also be delayed or offset, such that the left and right breaking waves may be staggered. The expert wave zone may be defined as an area adjacent or proximate the chambers. The wave within the expert wave zone may break along the wave-generating wall. The wave may retain an approximate constant height as the sequential release of water from the chambers may be used to maintain the wave formation. In an exemplary embodiment, the wave height in the expert wave zone may be approximately 1.5 to 3.5 meters (approximately 4 to 11 feet). After the wave leaves the area proximate the chambers, the wave will dissipate energy and the wave height will decrease. The wave extending along the side edge of the pool away from the chambers may form the intermediate wave zone with a wave height that is reduced from the expert wave zone. In an exemplary embodiment, the wave height in the intermediate wave zone may be approximately 1-2 meters (approximately 3 to 6 feet). The wave height may continue to decrease as it travels away from the chambers. The wave may thereafter break along the opposite side of the pool in the shallow area to create a beginner wave zone. In an exemplary embodiment, the wave height in the beginner wave zone may be approximately 0-1.5 meters (0 to 4.5 feet).

Figure 4:
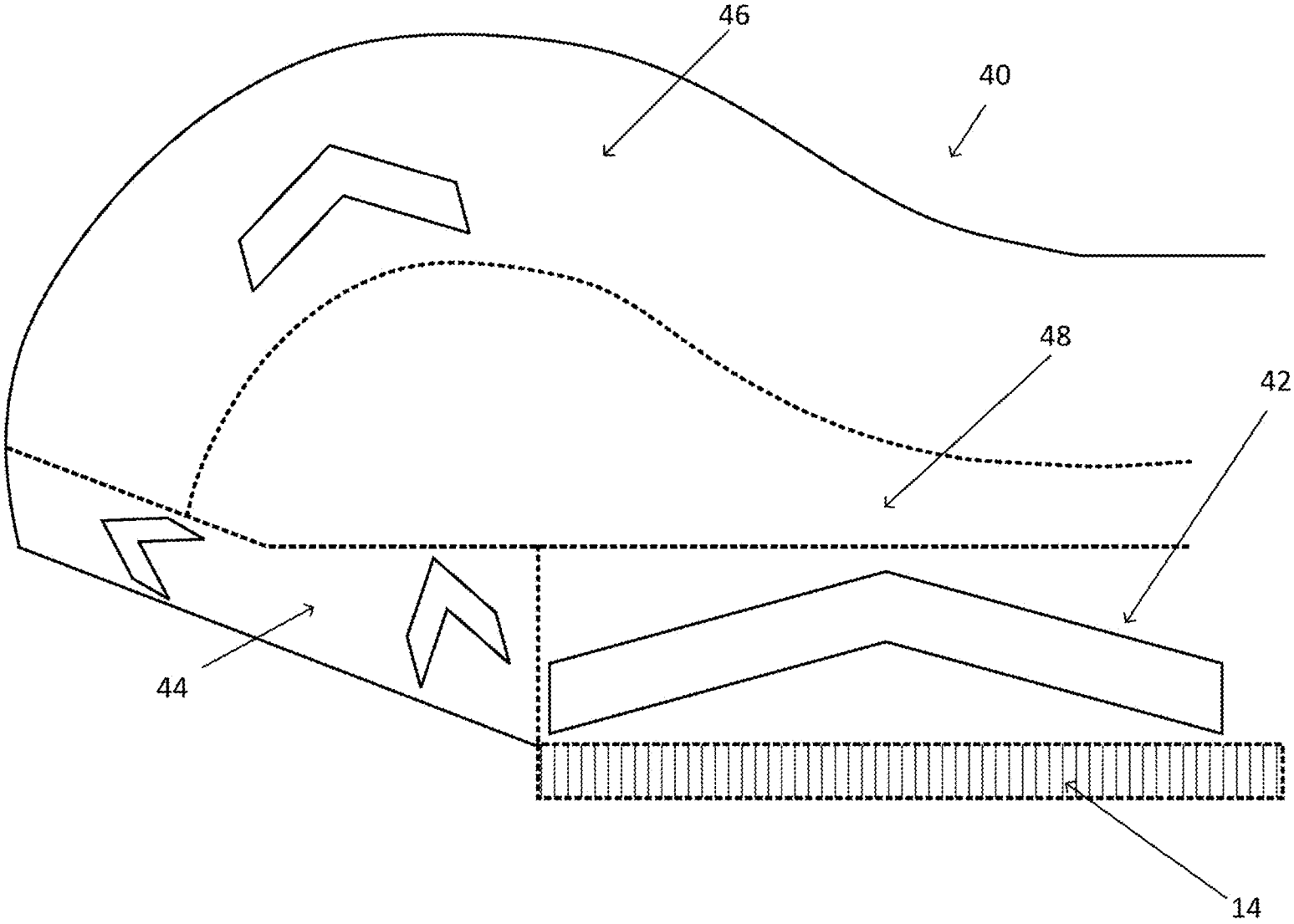
FIG. 4 illustrates an exemplary bottom zones corresponding to the different zones described in FIG. 3.
Figure 5A:
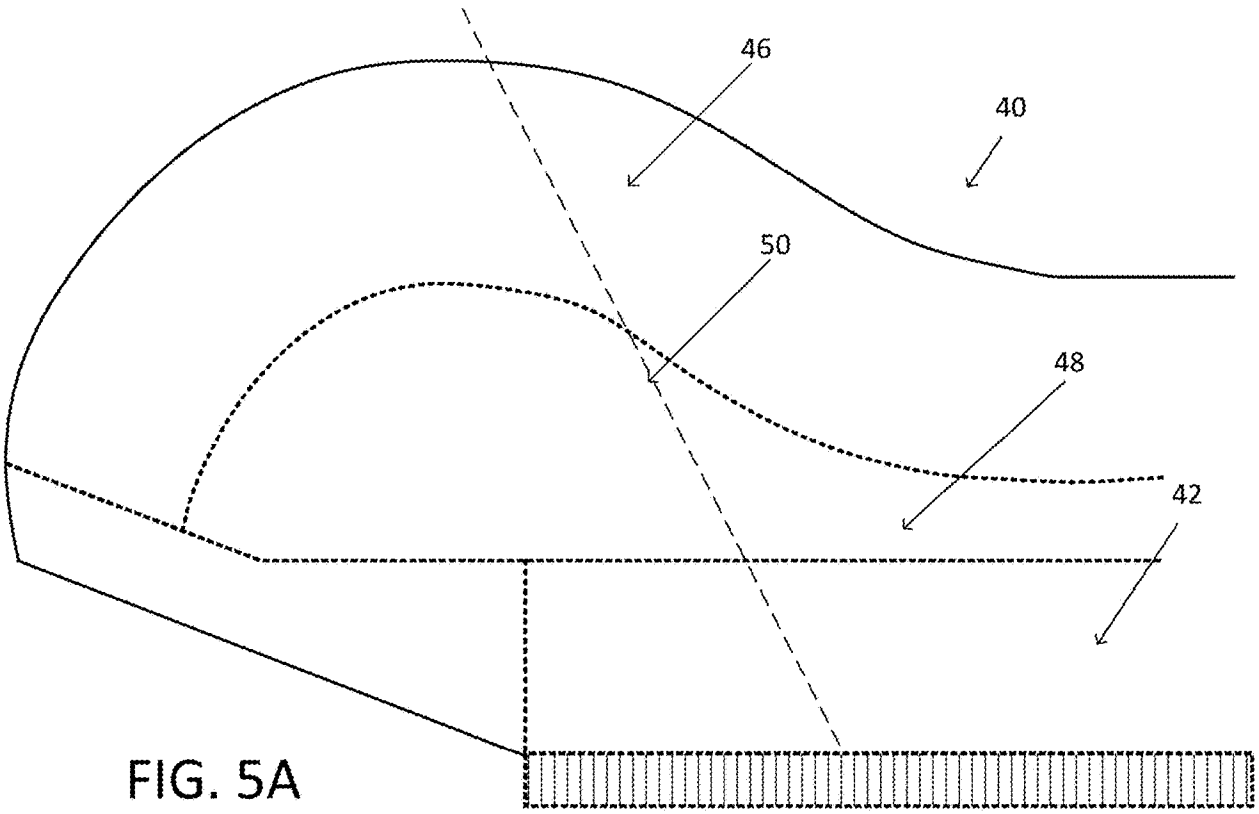
FIG. 5A and FIG. 5B illustrates the different bottom profile of the exemplary bottom zones of FIG. 4.
Figure 5B:
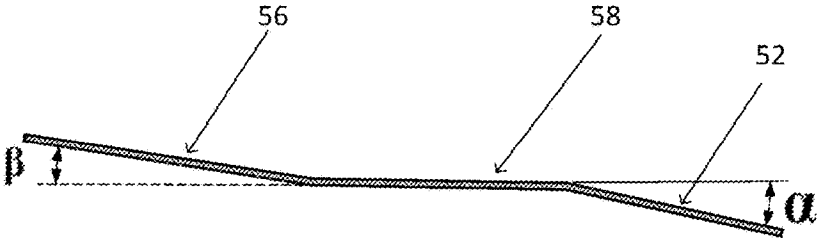

FIG. 4 illustrates an exemplary bottom profile corresponding to the different wave zones described in FIG. 3 of a pool wave system 40. FIG. 5A is the illustration of the exemplary bottom profile of FIG. 4 with a reference line 50. FIG. 5B illustrates the cross sectional perspective along the reference line 50 of FIG. 5A to illustrate an exemplary pool floor. As illustrated, the bottom profile may include at least three areas.

In an exemplary embodiment, a first area 42 may correspond to the area proximate the chambers 14. As seen in FIG. 5B, the pool floor 52 of this area may include a gradual slope upward such that the pool adjacent the chamber is deeper than the pool on an opposing side of the area 42 from the chamber. The slope may traverse from deeper to shallower moving across the area away from the chambers at an angle $\alpha$. The first area 42 may be generally rectangular and extend directly in front of the chambers as illustrated in FIG.

4. The first area 42 may also be flared at the ends such that the area traverses in front of the chambers and as the area slopes away from the chambers extends outward past the ends of the chambers, as illustrated in FIG. 3. Other shapes of this area are also contemplated.

In an exemplary embodiment, the third area 46 may correspond to the area on an opposite end of the pool form the chambers 14. The third area 46 may be on a side of the pool corresponding to an end of the wave travel that is opposite from the origin of the wave. The pool floor 56 of this area may have a more gradual slope than the slope of the area adjacent the chambers. The pool floor 56 may include a gradual slope upward such that the pool toward the first area 42 is deeper than the area on an opposite side thereof. The terminal end of this area may have a zero depth such that the water washes up the side to the surface of the wall. This area may approximate a beaching area. The slope may traverse from deeper to shallower moving across the area in a direction away from the chambers at an angle β. This area may correspond to a band or width at the terminal end of the wave at an opposing side of the pool from the chambers. As the chambers may generate a wave that propagates away from the chambers in an oblique angle and not directly perpendicular to a front face of the chambers, the opposing end of the pool may be offset and include a portion of the pool that ends past the lateral side end of the chambers. Opposite may therefore include directly or geometrically opposite as well as opposite based on the propagation of the wave generated from the chambers.

As illustrated, the third area 46 may be shaped in a curve such that portions of this area are further away from the chambers than other portions of this area. For example, the shore area 46' may be curved such that portions adjacent the lateral side of the pool corresponding to the ends of the chambers and toward a middle of the shore (for a mirrored pool) or the opposite lateral side of the pool (for a single sided pool) are positioned closer toward the chambers than areas there between. As illustrated, the shore region or the side of the pool opposite the chambers may therefore include three curved regions, two outside regions on opposing ends of the shore region in which the region is concave with the inward concavity toward the chambers, and an interior curved region between the two outside regions in the middle of the shore region is convex with the outward concavity toward the chambers. The concave and/or convex shore areas may include curvi-linear sections. For example, the interior portion of the concave or convex curved shore section may be extended to approximate a linear interior section so that the curvature of the concave or convex portion is not constant through the curve.

As illustrated, a second area 44 may extend from the first area 42 to the third area 46. This area may be similarly sloped. The slope of the area may be linear, curvi-linear, or curved. This area may include a gradual slope that transitions the bottom surface from the first area 42 to the third area 46. This area may also be contoured to provide a transition to any other area that may be included in the bottom profile. The second area 44 may therefore provide a transitional surface between two or more other floor bottom surfaces or areas.

The pool may include one or more other floor areas defining one or more other zones. For example, the first wave zone may be separated from the third wave zone. The separation may be to create a floor profile to recreate a desired waveform. The separation may be to permit space between the various wave zones for rider safety and/or rider enjoyment. As seen in FIGS. 3, 4, and 5, a transition area 48, 48' may be used. The transition area 48, 48' may correspond to floor bottom 58 that is generally flat. The transition area may be positioned between the first area 42 and the third area 46 and/or the shore area. As illustrated in FIG. 3, the first area 42' may contact the third area 46' in a middle portion of the pool, while the transition area 48' separates the first area 42' from the third area 46' toward outer lateral sides of the pool adjacent the second area 44'. In an exemplary embodiment, such as illustrated in FIG. 4, the transition area 48 may separate the first area 42 from the third area 46 along a length of the pool, such that the first area 42 does not contact the third area 46.

In an exemplary embodiment, the gradient of the pool floor bottom 52 corresponding to a first area 42, 42' is greater than the gradient of the pool floor bottom 56 corresponding to the third area 46, 46' ($\alpha \geq \beta$). In an exemplary embodiment, the gradient of the pool floor bottom of the second area 46, 46' is generally equal to either of or between the gradient of the first area and the second area ($\alpha \geq \theta \geq B$). The pool floor bottom 52 may have a slope of between 3 and 10 degrees. The pool floor bottom 56 may have a slope of greater than 0 degrees to 5 degrees. The pool floor bottom corresponding to the second area 46, 46' may have a slope of between 2 and 10 degrees.

The configuration, shape, elevation, slopes, and other features of the pool floor bottom described herein are exemplary only. Other or additional features may be added and are within the scope of the present description. For example, an additional sloped floor and/or one or more other level floor areas may also be included to create additional wave areas and/or separate wave areas. Other elements may also be included, such as floor configurations, walls, dividers, elevations, shore features, etc. to further enhance the surfing experience or to provide additional benefits to the pool wave generator described herein. These may include features for splitting, redirecting, reforming, or otherwise effecting the generated wave.

Figure 6:
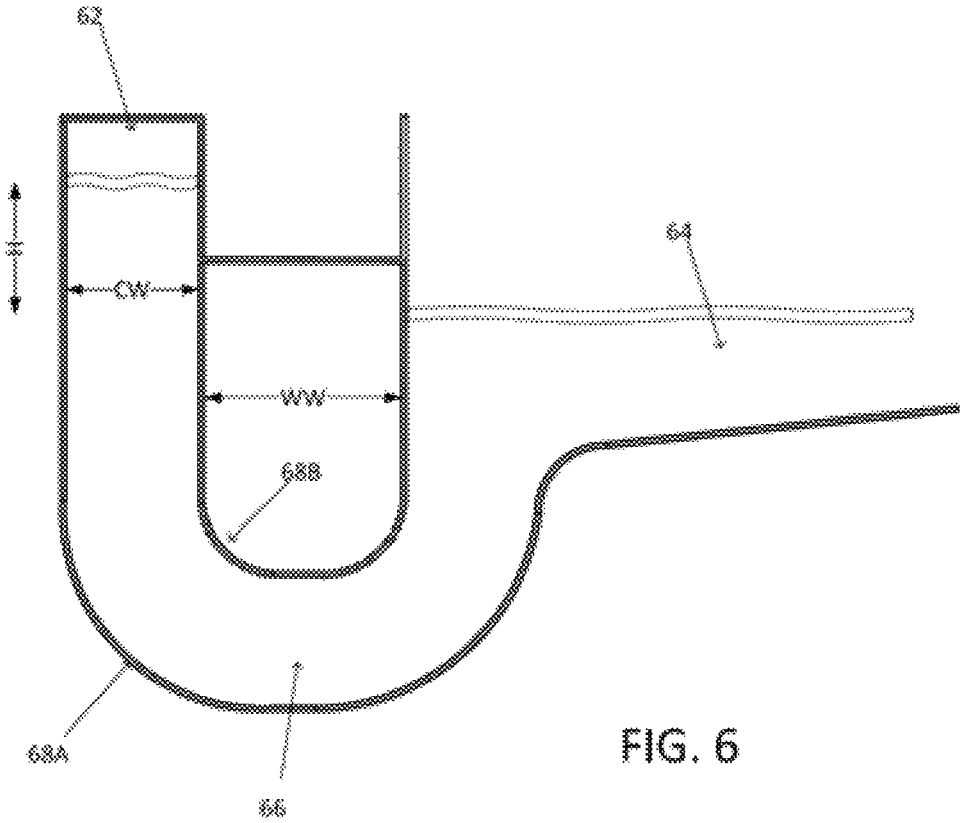
FIG. 6 illustrates an exemplary wave-generating chamber according to embodiments of the invention.

FIG. 6 illustrates an exemplary wave-generating chamber according to embodiments of the invention.

Conventional chamber configurations in which the chamber and pool share a common wall or in which the chamber and the pool are in close proximity create eddy currents through the area between the chamber and the pool. The eddy currents may interfere with the shape and stability of the generated wave. U.S. Pat. No. 10,526,806 discloses a vane positioned between or near the chamber and pool interface to control and direct the water movement and reduce the formation of eddy currents. Such systems create construction and maintenance costs as the vanes must be internally supported and maintained. Exemplary embodiments described herein permit the formation of a wave pool that may manage or reduce the formation of eddy currents without the use of a vane or an internal structure within or adjacent the water flow path between the chamber and pool.

The chamber 62 and the configuration of the chamber 62 to the pool 64 may be used to generate waves of desired characteristics. Exemplary embodiments use the chamber width CW and the width between the pool and the chamber (wall width) WW to control or influence the currents and waves generated by the chambers. In an exemplary embodiment, the width between the pool and the chamber, WW, is greater than 2 meters. The greater distance in this transition area between the chamber and the pool, however, can affect and reduce the height of a generated waved. Therefore, conventionally, it was desirable to keep this area as short as possible. This distance, however, can be used to reduce turbulence and create a better wave profile. In an exemplary embodiment, the distance between an edge of the pool and an edge of the chamber is between 2 and 7 meters (6 and 21 feet). The chamber width, CW, may influence the resulting height of the generated wave. Similar to the wall width WW, this dimension conventionally was reduced as the additional width necessitated additional power for controlling and releasing the wave. For example, additional gas would be needed to create the same pressure on the water surface. The chamber width CW is preferably 1.3 to 5 meters (approximately 4 to 15 feet).

In an exemplary embodiment, the chamber 62 may be coupled to the pool 64 by a passage 66. The passage may be positioned at a depth lower than the pool 64, such that water exits the chamber and enters the pool, on a bottom of the pool or adjacent to the bottom of the pool. The passage may be shaped such that the direction of water leaving the passage may have a vertical component. The passage may include an inner wall 68B and an outer wall 68A. The inner wall 68B and outer wall 68A may be curved to reduce turbulence imposed on the water as it passes through the passage from the chamber to the pool.

Figure 7:
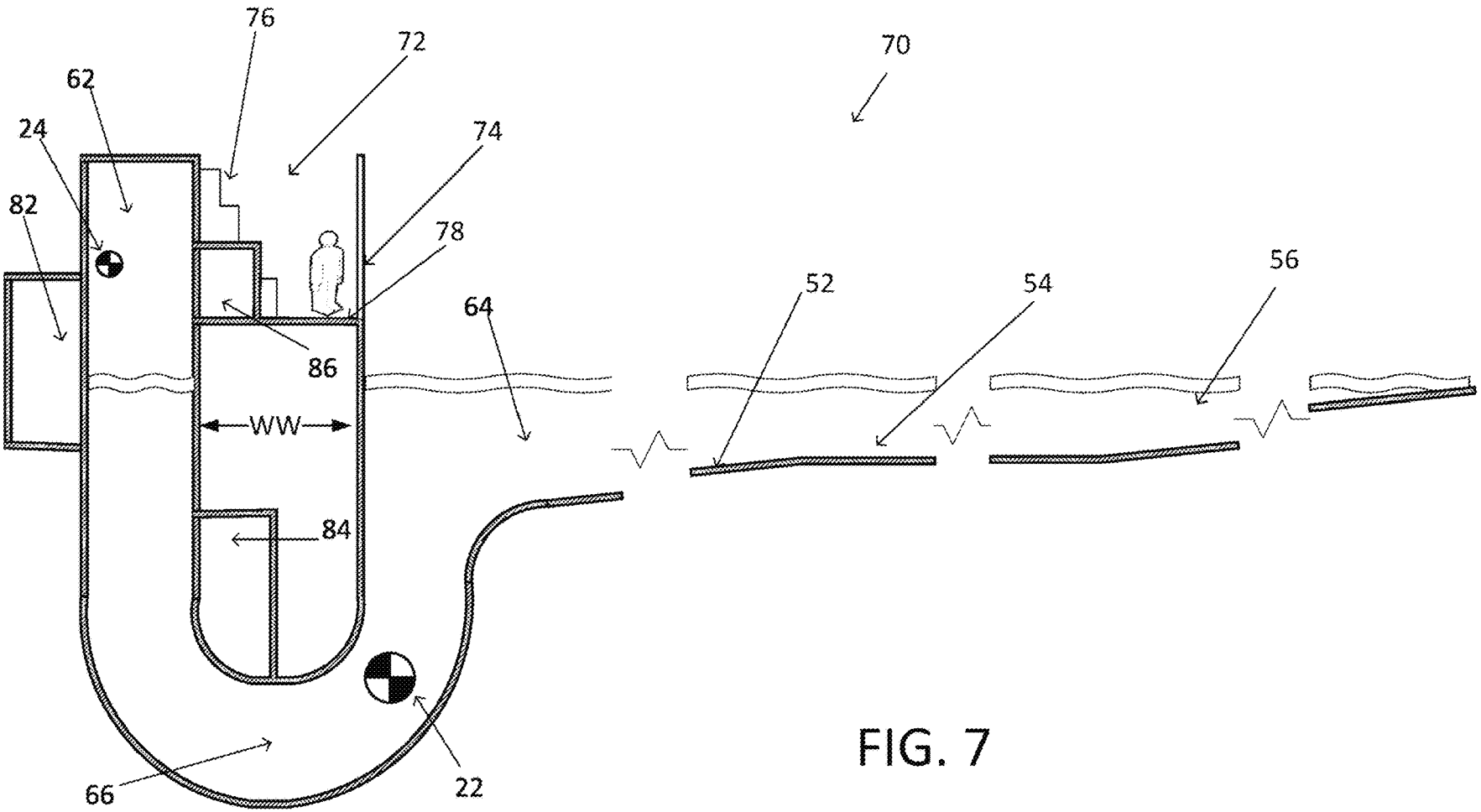
FIG. 7 illustrates an exemplary cross sectional profile of a wave pool according to embodiments of the invention.

FIG. 7 illustrates an exemplary cross sectional profile of a wave pool according to embodiments of the invention. The exemplary wave pool 70 may include any combination of features as described herein. For example, the system may include a pool 64 having a pool floor. The pool floor may have one or more different areas such as first sloped area 52 adjacent chamber 62, that transitions through a generally flat transition area 54 to a third sloped area 56. The chamber 62 may control the egress and ingress of water to and from the chamber through one or more valves 22, 24 as described herein.

As described herein, the terminal end of the pool 64 toward the chamber may be separated by the chamber by a width WW. In an exemplary embodiment, the separation between the chamber and the pool may permit spectator observation. As illustrated in FIG. 7, the space between the pool 64 and the chamber 62 includes a floor 78 in which an observer may stand. The floor may be positioned around the water height of the pool 64 or positioned higher to provide better viewing of a rider in the area adjacent the chambers or in the rest of the pool. This area may include bleachers 76 or other sitting area or walkway to permit pedestrians and/or observers to pass by or observe the action within the pool.

In an exemplary embodiment, the separation between the chamber and the pool may permit storage of system components in addition to or in place of spectator observation. For example, the area between the pool 64 and the chamber 62, positioned over passage 66, may include the space for the air plenum, pump equipment, blowers, electronics, controllers, equipment room, or other system components. As illustrated, the bleacher or sitting area may incorporate an equipment room 86. The space under the floor 78 or otherwise positioned between the chamber and the pool may include other component parts, such as a space for the air plenum, electronics, controllers, or other equipment. As illustrated, the area between the pool and chamber includes a space for the air plenum 84 and behind the chamber 62 is positioned the electrical room 82.

In an exemplary embodiment, the space between the pool 64 and the area 72 between the pool and the chamber 62 may be open and/or unobstructed. In this case, a rider, swimmer, and/or lifeguard may be able to enter the pool area from the floor 78 on the wave generating side of the pool. In an exemplary embodiment, a wall 74 may extend beyond the height of the water to separate the space between the pool and the chamber from the pool itself. The wall 74 may be an extension of the side of the pool over the passage entrance. The wall 74 may be of an acrylic, plastic or other semi-transparent or transparent material to permit observation of the activities within the pool at a location outside of the pool. The wall 74 may protect observers from getting wet or accidentally falling into the pool.

That which is claimed is:

1. A pool wave generator comprising:
one or more chambers; and
a pool area, the one or more chambers positioned on a first side of the pool area, the pool area further comprising:
a first lateral side extending outwards from a first terminal end of the first side;
a second lateral side extending outwards from a second terminal end of the first side, the second terminal end defined opposite on the first side from the first terminal end;
a pool interior positioned at least partially between the first lateral side and the second lateral side; and
a shore side positioned opposite from the first side, the shore side defining a first lobe and a second lobe, the shore side further defining an interior indentation between the first lobe and the second lobe.

2. The pool wave generator of claim 1, wherein the one or more chambers are linearly aligned along the first side.

3. The pool wave generator of claim 2, wherein an interior angle between the first side and the first lateral side is an obtuse angle.

4. The pool wave generator of claim 3, wherein the interior angle is between 110 degrees and 170 degrees.

5. The pool wave generator of claim 3, wherein the interior angle is between 135 degrees and 150 degrees.

6. The pool wave generator of claim 1, wherein the first lateral side and the second lateral side taper inwards from the shore side toward the first side of the pool area.

7. The pool wave generator of claim 1, wherein a pool floor bottom of the pool area tapers upwards from the first side to the shore side.

8. The pool wave generator of claim 7, wherein the pool floor bottom defines a first portion, a second portion, and a third portion, the first portion positioned adjacent to the first side, the second portion positioned between the first portion and the third portion, the third portion positioned adjacent to the shore side, the first portion extending upwards and away from the first side, the second portion being a horizontal area, and the third portion extending upwards towards the shore side.

9. The pool wave generator of claim 8, wherein:
the first portion extends upwards at a first angle;
the third portion extends upwards at a second angle; and
the first angle is greater than or less than the second angle.

10. The pool wave generator of claim 8, wherein the first portion, the second portion, and the third portion each respectively extend from the first lateral side to the second lateral side.

11. The pool wave generator of claim 1, wherein the first lateral side and the second lateral side are each linear.

12. The pool wave generator of claim 1, wherein the second lateral side is a mirror configuration of the first lateral side.

13. A pool wave generator comprising:
one or more chambers; and
a pool area comprising a first side and a shore side positioned opposite from the first side,
wherein the one or more chambers are positioned on the first side of the pool area,
wherein the shore side defines:

a concave curve relative to an interior of the pool area; and a convex curve relative to the interior of the pool area, wherein the convex curve extends from the concave curve.

14. The pool wave generator of claim 13, wherein:

the concave curve is a first concave curve;

the shore side further defines a second concave curve relative to the interior of the pool area; and the convex curve is defined between the first concave curve and the second concave curve.

15. The pool wave generator of claim 14, wherein the first concave curve at least partially defines a first lobe, and wherein the second concave curve at least partially defines a second lobe.

16. The pool wave generator of claim 14, wherein the first concave curve intersects a first lateral side of the pool area.

17. The pool wave generator of claim 16, wherein the second concave curve intersects a second lateral side of the pool area.

18. The pool wave generator of claim 13, wherein the one or more chambers are linearly aligned along the first side.

19. The pool wave generator of claim 13, wherein the pool area further defines a first lateral side and a second lateral side each extending between the first side and the shore side.

20. The pool wave generator of claim 13, wherein a pool floor bottom of the pool area tapers upwards from the first side to the shore side.

21. The pool wave generator of claim 20, wherein the pool floor bottom defines a first portion, a second portion, and a third portion, the first portion positioned adjacent to the first side, the second portion positioned between the first portion and the third portion, the third portion positioned adjacent to the shore side, the first portion extending upwards and away from the first side, the second portion being a horizontal area, and the third portion extending upwards towards the shore side.

22. The pool wave generator of claim 21, wherein:

the first portion extends upwards at a first angle;

the third portion extends upwards at a second angle; and the first angle is not equal to the second angle.

23. A pool wave generator comprising:

one or more chambers; and a pool area, the one or more chambers positioned on a first side of the pool area, the first side defined by a first linear wall, the one or more chambers linearly aligned parallel to the first linear wall, the pool area further comprising:

a first lateral side extending outwards from a first terminal end of the first side, the first lateral side at least partially defined by a second linear wall, an interior angle between the first side and the first lateral side being between 130 degrees and 170 degrees;

a second lateral side extending outwards from a second terminal end of the first side, the second terminal end defined opposite on the first side from the first terminal end, the second lateral side at least partially defined by a third linear wall, the second linear wall and the third linear wall tapering inward toward the first linear wall;

a pool interior positioned at least partially between the first lateral side and the second lateral side; and a shore side positioned opposite from the first side, the shore side defining a first lobe and a second lobe, the shore side further defining an interior indentation between the first lobe and the second lobe, the first lobe defined at least partially by a first concave curve relative to the pool interior, the second lobe defined at least partially by a second concave curve relative to the pool interior, the interior indentation defined at least partially by a convex curve relative to the pool interior, the first concave curve intersecting the second linear wall of the first lateral side.

24. The pool wave generator of claim 23, wherein the second lateral side is a mirror configuration of the first lateral side.

25. The pool wave generator of claim 23, wherein the second concave curve intersects the third linear wall of the second lateral side.

26. The pool wave generator of claim 23, wherein the interior angle is between 150 degrees and 160 degrees.

27. The pool wave generator of claim 23, wherein a pool floor bottom of the pool area tapers upwards from the first side to the shore side.

28. The pool wave generator of claim 27, wherein the pool floor bottom defines a first portion, a second portion, and a third portion, the first portion positioned adjacent to the first side, the second portion positioned between the first portion and the third portion, the third portion positioned adjacent to the shore side, the first portion extending upwards and away from the first side, the second portion being a horizontal area, and the third portion extending upwards towards the shore side.

29. The pool wave generator of claim 28, wherein:

the first portion extends upwards at a first angle;

the third portion extends upwards at a second angle; and the first angle is not equal to the second angle.

30. The pool wave generator of claim 29, wherein the first angle is different from the second angle.

* * * * *